US006131405A

United States Patent [19]

Griffin et al.

[11] Patent Number: 6,131,405

[45] **Date of Patent: *Oct. 17, 2000**

[54] DISCHARGE SEPARATOR AND MUFFLER FOR REFRIGERATION, AIR CONDITIONING AND HEAT PUMP SYSTEMS

[75] Inventors: Gary E. Griffin, Penn Yan; Robert F. Prayne, Seneca Falls, both of N.Y.

[73] Assignee: Parker-Hannifin Corporation, Cleveland, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/193,143

[22] Filed: Nov. 17, 1998

Related U.S. Application Data

[60] Provisional application No. 60/067,787, Dec. 3, 1997.

[51] Int. Cl.[7] ..... F25B 43/02

[52] U.S. Cl. ..... 62/470; 62/84

[58] Field of Search ..... 62/470, 512, 473, 62/84

[56] References Cited

U.S. PATENT DOCUMENTS

| | | |
|---|---|---|
| 2,511,967 | 6/1950 | Campbell . |
| 2,606,430 | 8/1952 | Pownall . |
| 3,200,568 | 8/1965 | McNeil . |
| 3,304,697 | 2/1967 | Ramsey . |
| 3,778,984 | 12/1973 | Lawser . |
| 4,263,029 | 4/1981 | George . |
| 4,478,050 | 10/1984 | DiCarlo et al. . |
| 4,503,685 | 3/1985 | DiCarlo et al. . |
| 4,506,523 | 3/1985 | DiCarlo et al. . |
| 4,662,190 | 5/1987 | Tischer . |
| 4,690,759 | 9/1987 | Mandy . |
| 5,113,671 | 5/1992 | Westermeyer . |
| 5,218,832 | 6/1993 | Woolley . |
| 5,271,245 | 12/1993 | Westermeyer . |
| 5,404,730 | 4/1995 | Westermeyer . |
| 5,551,253 | 9/1996 | Kim . |
| 5,553,460 | 9/1996 | Isaacs . |

*Primary Examiner*—Henry Bennett
*Assistant Examiner*—Melvin Jones
*Attorney, Agent, or Firm*—Christopher H. Hunter

[57] ABSTRACT

A device for separating oil from an oil/gas mixture in a refrigeration or heat pump system includes a cylindrical housing circumscribing a central axis with upper and lower end caps. A scroll-shaped separator baffle disposed in the housing defines a flow path extending radially-inward in a spiral manner from a peripheral region of the housing toward the central axis of the housing. An inlet conduit in the upper end cap directs an oil/gas mixture into the housing. An upper baffle plate supporting an upper end of the separator baffle directs the oil/gas mixture from the inlet to the peripheral region of the housing and into the separator baffle. The oil in the mixture generally separates from the gas in the mixture and deposits on the wall of the separator baffle the mixture flows radially inward through the separator baffle. An outlet conduit in the lower end cap aligned with the central axis and extending upwardly into the separator baffle directs the resulting oil-free gas stream from the housing. The oil on the baffle wall coalesces and drains downwardly through filter media supported in a lower baffle assembly at a lower end of the separator baffle. The filtered oil can be either directed through a drain tube to appropriate components, or directed through an opening in the outlet conduit for re-introduction into the gas stream.

31 Claims, 4 Drawing Sheets

DISCHARGE SEPARATOR AND MUFFLER FOR REFRIGERATION, AIR CONDITIONING AND HEAT PUMP SYSTEMS

RELATED CASES

The present application claims priority to U.S. Provisional Application Ser. No. 60/067,787; filed Dec. 3, 1997.

FIELD OF THE INVENTION

This invention relates generally to refrigeration, air conditioning, and heat pump systems, and specifically to an improved oil separator for such systems.

BACKGROUND OF THE INVENTION

Conventional refrigeration systems, such as found in automotive air conditioning applications, include a compressor, a condenser, an expansion device, and an evaporator. Refrigerant is circulated through the system to produce cooling. Energy is provided to the system by the compressor which serves to create a source of high pressure gas (or vapor) refrigerant which is allowed to pass through the condenser. The refrigerant dissipates heat in the condenser and changes state to a high pressure liquid. The refrigerant then passes through the expansion device and into the evaporator where the refrigerant changes from a high pressure liquid to a low pressure liquid, and subsequently to a low pressure gas. The change of state removes heat from the area surrounding the evaporator. The refrigerant is then drawn from the evaporator back to the compressor in a low pressure gas form, where it is again compressed into high pressure gas for repetition of the cycle.

An accumulator is normally located between the evaporator and the compressor. The accumulator ensures that only refrigerant in a gas stage passes into the compressor, as refrigerant from the outlet of the evaporator often includes both a liquid component and a gas component.

A heat pump system is similar to a refrigeration system, but operates in reverse to produce heating, rather than cooling. A reversing valve downstream of the compressor can be used when the system is intended to operate in both a heating and cooling mode.

In both a refrigeration and heat pump system, the compressor normally introduces oil into the gas stream exiting the compressor. In a refrigeration system, the oil can coat the interior walls of the downstream condenser and reduce the efficiency and heat transfer of the condenser, and generally serves no purpose downstream of the compressor. For maximum efficiency, the oil may be removed from the gas stream exiting the compressor and returned to the suction line of the compressor. In a heat pump system, the oil can be returned to the compressor, or can be directed downstream to lubricate downstream components.

An oil separator is normally located in the discharge line of the compressor in both a refrigeration and heat pump system to separate the oil from the gas and direct the oil-free gas downstream of the compressor. The separator may also be equipped to filter the oil to remove harmful particulates in the oil. The oil can then be returned to the system, such as to the suction line of the compressor, introduced back into the gas stream, or directed to other appropriate components in the systems such as sumps, accumulators, pumps, oil float controls and valves, etc. In a refrigeration system, the oil separator ensures that only oil-free gas passes from the compressor to the condenser to maintain the condenser at maximum efficiency; while in a heat pump system, the separator filters the oil to prevent damage to downstream components.

In order to remove the oil from the gas stream, some oil separators impart a tangential flow pattern to the oil/gas mixture entering the housing, such that centrifugal forces will cause the oil droplets to be directed outwardly against the inside walls of the housing. The oil droplets will then coalesce and drip downwardly under gravity into a collection area, where the oil can then be removed.

One such oil separator is shown in U.S. Pat. No. 5,551,253. This separator includes a housing enclosing an upper perforated baffle plate, a lower perforated baffle plate and a filter disposed between the baffle plates. Oil and gas passing through the baffle plates and filter exits the lower baffle plate through guiding holes which impart a swirling component to the mixture. The oil in the mixture is displaced outwardly by centrifugal forces against the interior walls of the housing beneath the baffle plate and filter assembly, and then gravitates downwardly for collection at the bottom of the chamber. The oil-free gas is discharged through an outlet pipe positioned centrally within the chamber. An apertured separating plate is situated between the lower buffer plate and the collected oil to isolate the collected oil from the swirling gas.

Other oil separators have an inlet conduit which introduces the oil/gas mixture tangentially into the housing to achieve the same results. These separators are shown for example in U.S. Pat. Nos. 2,511,967, 4,690,759, 3,778,984 and 4,263,029. Another oil separator is shown in U.S. Pat. No. 4,478,050, where a series of deflector tabs are provided along the walls of the housing to assist the tangential flow of the mixture.

Still another oil separator is shown in U.S. Pat. No. 5,113,671. In this patent a helical wall or auger is provided between the gas outlet conduit and the peripheral wall of the housing to cause the oil/gas mixture to flow in a largely circumferential path along the peripheral wall. The flights of the helix extend substantially radially outward from the central axis (surrounding the outlet conduit) to the peripheral wall of the housing. The oil droplets in the gas collect on a screen around the inside surface of the wall and drip downwardly. An inverted funnel/baffle at the lower end of the housing includes apertures which drain the oil into a lower collection area for removal. U.S. Pat. Nos. 5,271,215, 5,404,730, 5,553,460 and 4,263,029 show similar helical walls or augers operable to separate the oil from the incoming oil/gas mixture.

While the above oil separators appear to have enjoyed some acceptance in the market place, they require a considerable length to effectively remove oil from the gas stream with a tangential flow path. This requires the housing to be relatively long, which increases the material costs, as well as requires additional space in the refrigeration system. It is therefore believed desirable to reduce the size of the separator, while still maintaining effective separation of oil from the oil/gas mixture, and filtering of the oil.

Compressor-induced gas pulsations may transmit objectionable noise to downstream components. Many systems require a muffler to reduce this noise. It is therefore believed also desirable to reduce the noise levels in the oil separator.

Still other oil separators can be overwhelmed during start-up of the system where a slug of liquid refrigerant and entrained oil from the compressor can pass to the separator. The refrigerant and oil can clog the filter media when the media is disposed between the inlet and outlet (such as shown in U.S. Pat. No. 5,551,253), and cause an undesirable pressure drop across the separator while the oil and refrigerant drain through the media. It is therefore believed that there is a demand for an oil separator which prevents pressure drops across the separator-even during difficult conditions such as at start-up of the system.

It is further believed that there is a continual demand in the industry for an oil separator which effectively and efficiently separates oil from the gas stream, directs the oil-free gas to the downstream components, and filters the oil, and then directs or returns the filtered oil to the appropriate components in the system.

SUMMARY OF THE INVENTION

The present invention provides a new and unique oil separator for refrigeration and heat pump systems which effectively and efficiently separates oil from an incoming oil/gas mixture from the compressor discharge line, directs the oil-free gas to the downstream components in the system, and filters the oil. The filtered oil is then either externally drained and directed to other appropriate components in the system, such as to the suction line of the compressor, or returned directly to the outlet conduit to be reintroduced into the gas stream. The separator also has an internal structure which reduces or muffles the noise caused by the gas/oil mixture flowing through the separator.

According to the principles of the present invention, the separator includes a cylindrical housing enclosing a scroll-shaped separator baffle. The wall of the separator baffle defines a flow path extending radially-inward in a spiraling manner from a peripheral region of the housing toward the central axis of the housing. The wall generally extends parallel to the central axis of the housing, and includes an outer end adjacent the peripheral wall of the housing, and an inner end which surrounds an outlet conduit extending upwardly into the housing.

The oil/gas stream is introduced into the peripheral region of the housing and flows radially-inward through the scroll-shaped separator baffle. The oil in the mixture separates from the gas in the mixture by centrifugal forces and deposits on the wall of the baffle as the mixture flows radially-inward. The scroll-shaped baffle accelerates the fluid as the fluid is directed inwardly, which results in increased oil separation along the baffle wall. This allows a small and compact scroll-shaped baffle to achieve efficient and effective oil separation, which reduces the size of the housing. The baffle also dampens compressor pulsations of the oil/gas mixture passing through the separator, which reduces noise from the separator.

The oil coalescing on the wall of the separator drains down through a filter into a collection cavity at the lower end of the housing, while the oil-free gas passes out through the outlet conduit. The filtered oil can be can be directed through a drain tube for use at a remote location in the system, or in another form of the invention, can be directed through an opening in the outlet conduit back into the gas stream to lubricate downstream components. The separator with scroll-shaped separator baffle can also absorb a slug of liquid refrigerant and oil up to the level of the outlet conduit in the scroll while maintaining oil separation, and, at higher levels, can even allow unfiltered oil to pass through the separator without a pressure drop.

The housing for the separator baffle includes an inlet baffle plate which supports the upper end of the separator baffle and directs the oil/gas mixture to the peripheral region of the housing and into the separator baffle, and a lower baffle assembly which includes an upper perforated plate which supports the lower end of the separator baffle, the filter for separating particles from the oil, a fine mesh screen, and a lower perforated plate.

The above-described oil separator effectively and efficiently separates oil from the incoming oil/gas mixture from the compressor discharge line and directs the oil-free gas to the downstream components. The separator also filters the oil, and directs or returns the filtered oil to the appropriate components in the system. The separator further reduces or muffles the noise caused by the gas/oil mixture flowing through the separator.

Further features of the present invention will become apparent to those skilled in the art upon reviewing the following specification and attached drawings.

DETAILED DESCRIPTION OF THE PREFERRED EMBODIMENT

Figure 1:
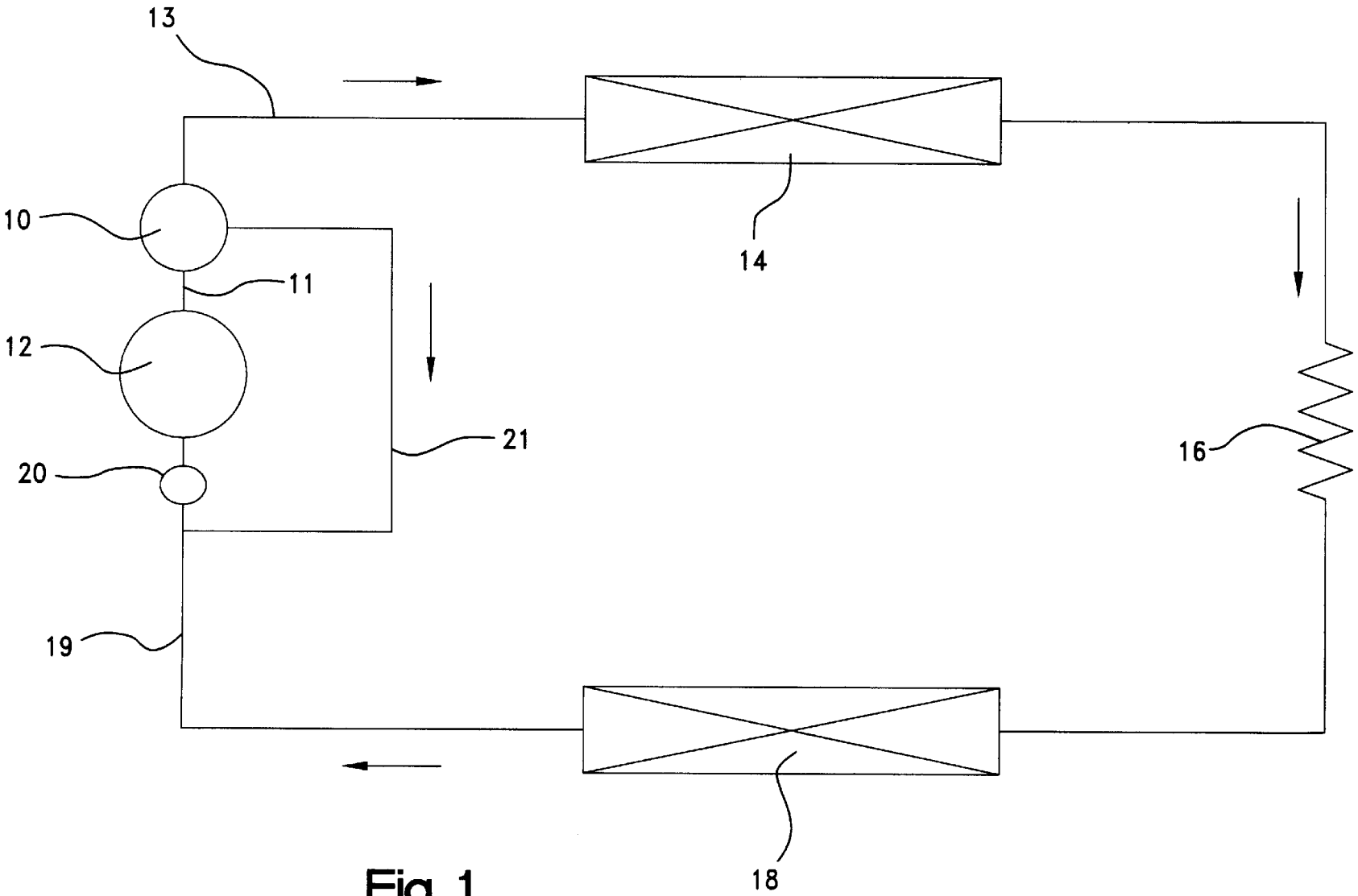
FIG. 1 is an illustration of a refrigeration system including an oil separator constructed according to the present invention.

Referring to the drawings and initially to FIG. 1, an oil separator constructed according to the principles of the present invention is indicated at 10. The separator 10 is shown connected between the discharge line 11 of the compressor 12 and the inlet line 13 to a condenser 14. The condenser is in turn connected through a pressure reducing apparatus 16, such as an expansion valve, to a evaporator 18. The evaporator 18 is connected to the suction line 19 of the compressor 12. A liquid separator 20, such as an accumulator, may be located between the evaporator 18 and compressor 12. The above-described components can be operated in one mode as a refrigeration system, or as should be apparent to those skilled in the art, can be operated in a reverse mode as a heat pump. In either case, as will be described more fully below, separator 10 filters and separates oil from the oil/gas mixture received on the discharge line 11 of the compressor and then directs the oil-free gas to the downstream components in the system via inlet line 13, and filters the oil and either directs the filtered oil through return line 21 to the suction line 19 of the compressor (or to other appropriate components in the system), or returns the filtered oil back to the gas stream for lubricating downstream components.

Figure 2:
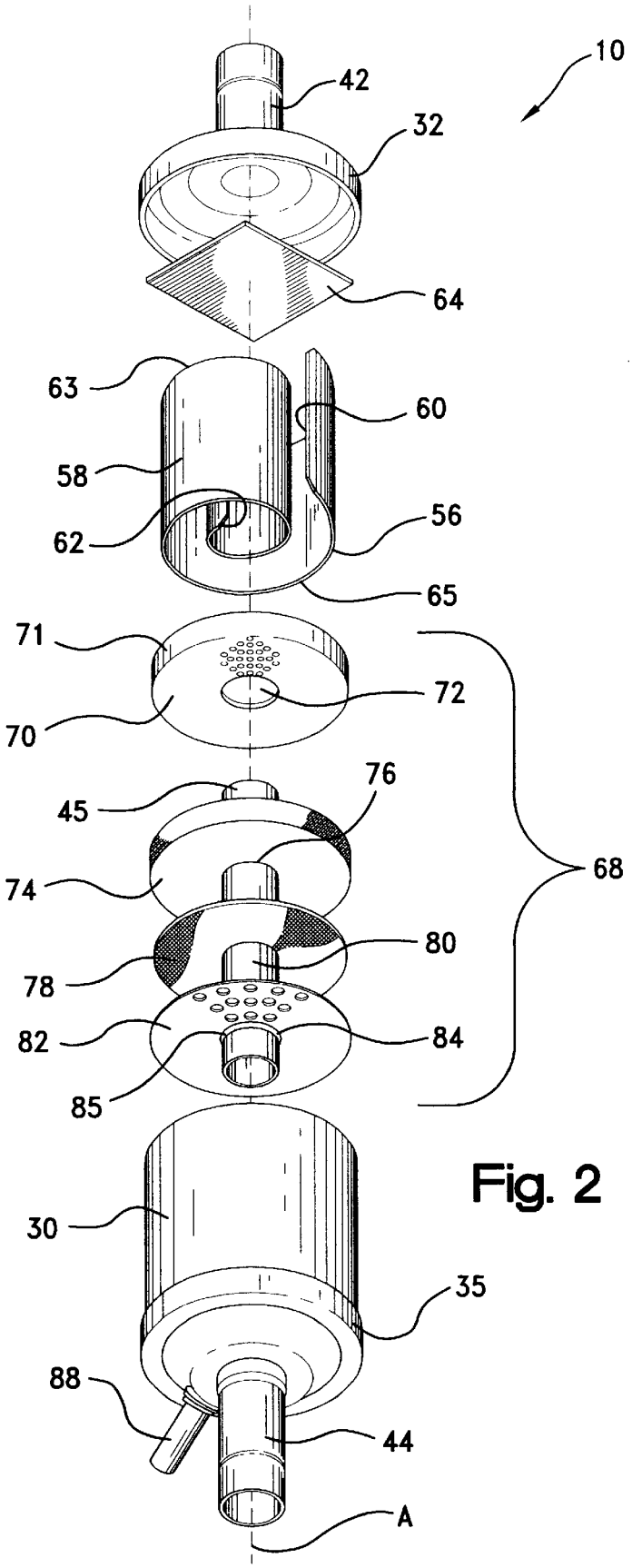
FIG. 2 is an exploded, partially-assembled perspective view of a separator for the system of FIG. 1.
Figure 3:
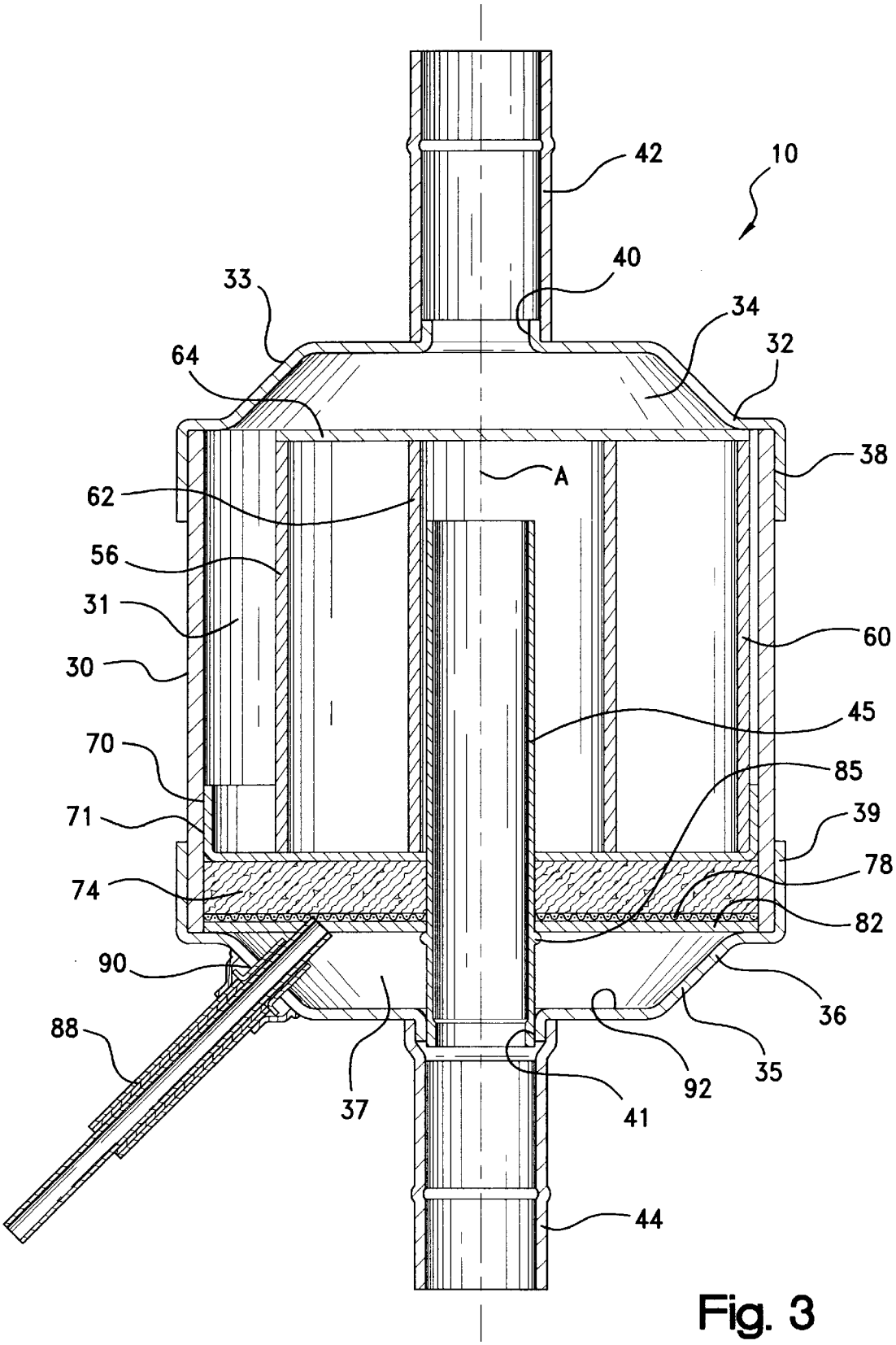
FIG. 3 is a cross-sectional assembled view of the separator of FIG. 2.

Referring now to FIGS. 2 and 3, the separator 10 of the present invention will be more fully described. The separator 10 includes an outer cylindrical housing or shell 30 which circumscribes a central longitudinal axis "A". Cylindrical housing 30 generally defines an inner separation cavity, indicated at 31. A first circular end cap 32 is disposed at the upper end of the cylindrical body 30. The upper end cap 32 includes an enlarged well portion 33 which defines a receiving cavity 34 at the upper end of separation cavity 31. A second circular end cap 35 is disposed at the lower end of the cylindrical body 30. The lower end cap 35 also includes an enlarged well portion 36 which defines a collection cavity 37 at the lower end of the separation cavity 31.

The upper end cap 32 includes an outer annular flange 38 which extends downwardly along a portion of the cylindrical housing, while lower end cap 35 includes an outer annular flange 39 which extends upwardly along a portion of the cylindrical housing. The annular flanges 38, 39 can be attached to the housing 30 by soldering, welding, brazing or other appropriate means to securely attach the end caps to the housing.

The upper end cap 32 includes an inlet opening along the central axis defined by an annular flange 40, while the lower end cap includes an outlet opening along the central axis defined by annular flange 41. An inlet tube or conduit 42 for directing an oil/gas mixture from compressor discharge line 11 into the receiving cavity 34 surrounds inlet opening flange 40 and can be attached to the upper end cap 32 such as by soldering, welding, brazing or other appropriate means. Likewise, an outlet tube or conduit 44 to direct fluid from the separation cavity 31 to the inlet line 13 of condenser 14 surrounds outlet opening flange 40 and can be attached to the lower end cap 35 also such as by soldering, welding, brazing or other appropriate means.

Outlet conduit 44 includes an inner extension portion 45 extending upwardly into the housing 30 toward upper end cap 32. Conduit portion 45 preferably extends a substantial distance upwardly through the housing, and preferably to a point which is about one tube diameter from the upper baffle plate 64. The lower end of conduit portion 45 is sized so as to be closely received within the upper end of conduit 44, and can be secured thereto such as by soldering, welding, brazing or other appropriate means.

A scroll-shaped separator baffle 56 is disposed within the separation cavity 31 of the separator 10. The separator baffle 56 comprises a wall 58 which defines a flow path extending radially-inward in a spiraling manner from a peripheral region of the housing 30 toward the central axis of the housing. Wall 58 has flat, smooth surfaces and preferably extends generally parallel to the axis of the housing. The wall 58 has a flat edge 60 at the outer end which is disposed adjacent to the peripheral wall 30 of the housing. Baffle 56 also includes an edge 62 at the inner end which is closely adjacent to conduit portion 45 extending upwardly within baffle 56. Edge 62 can also be flat, or more preferably, can taper slightly inwardly toward a central point. The radius of the scroll-shaped baffle 56 continuously decreases as the wall of the baffle spirals inwardly around the conduit portion 45 from the outer edge 60 to the inner edge 62. The wall 58 preferably has at least one and one-half individual turns which are evenly spaced from each other along the length of the baffle, although the number of turns of the baffle can be increased or decreased depending upon the composition of the incoming fluid, and the desired flow characteristics.

The separator baffle 56 is supported along its upper flat side edge 63 (FIG. 2) by an upper baffle plate 64. Baffle plate 64 preferably has an imperforate, square or multi-sided configuration which fits within the downwardly-extending flange 38 of the upper end cap 32. Alternatively, plate 64 can have a circular configuration closely fitting within flange 38 and with a series of apertures formed toward the periphery thereof. In any case, upper baffle plate 64 directs fluid coming into receiving cavity 34 to the periphery of separation cavity 31 in housing 30. The fluid then flows downwardly around the periphery of scroll 56, and then radially inward through the flow path defined by wall 58 toward the central axis of the housing.

Separator baffle 56 is supported on its lower flat side edge 65 (FIG. 2) by a lower baffle assembly, indicated at 68. Lower baffle assembly 68 includes an upper perforated, annular baffle plate 70 which directly supports the separator baffle 56 and has a central opening 72 which closely receives the outlet conduit portion 45. Upper baffle plate 70 also has an upwardly-extending annular flange 71 which is closely received within cylindrical body 30 and also closely receives the lower end of the separator baffle 56 (see FIG. 3). A fibrous filter media disc 74 is disposed against the lower (downstream) side of plate 70. Media disc 74 also has a central opening 76 which receives outlet conduit portion 45. An annular fine mesh screen 78 is then disposed against the downstream side of the media disc 74, and also includes a central opening 80 to receive outlet conduit portion 45. Finally, a lower perforated annular baffle plate 82 is disposed against the downstream side of mesh 78. Lower baffle plate 82 is similar to upper baffle plate 70 and also includes a central opening 84 to closely receive outlet conduit portion 45. The upper and lower baffle plates 70, 82, media disc 74 and mesh screen 78 can be inserted one-at-a-time over outlet conduit portion 45, or alternatively, pre-assembled and then inserted over outlet conduit portion 45. In any case, outlet conduit portion 45 includes a circular bead 85 which supports the lower end of the lower baffle assembly 68. The outer peripheral portion of lower baffle assembly 68 is also supported against the annular portion of the lower end cap 35 surrounding well area 36.

Referring particularly to FIG. 3, a drain tube connection 88 is disposed within a drain hole 90 in the lower well area 37 of the lower end cap 35. A drain tube 92 is connected to the drain tube connection 88 and extends inwardly into the collection cavity 37. Drain tube connection 88 and drain tube 92 draw oil out of the collection cavity 37, and can be connected to return line 21 (FIG. 1) to reintroduce the oil into the compressor suction line 19, or can be connected to other appropriate components. This form of the invention illustrated in FIGS. 2 and 3 is particularly suited for refrigeration systems, although it is also useful for heat pump systems.

The operation of the separator 10 should be apparent from the description above, however it will also now be briefly described. The oil/gas mixture is introduced through inlet conduit 42 and passes into receiving cavity 34. Upper baffle plate 64 directs the mixture to the peripheral region of the separator baffle 56, where the mixture then flows radially inward through the scroll toward the central axis. Centrifugal forces cause the heavier oil droplets to collect on the wall 58 of the scroll. The constantly decreasing radius of the scroll also accelerates the mixture, which facilitates separating the oil droplets outwardly against wall 58. The oil collects and coalesces on the inwardly-facing surface of wall 58, and drains downwardly by the force of gravity through the lower baffle assembly 68. Particulate matter is entrapped within media disk 74 and/or filter screen 78 of the lower baffle assembly. The filtered oil then collects in collection cavity 37 where it is drained through drain tube 92 and drain tube connection 88 as appropriate.

Figure 4:
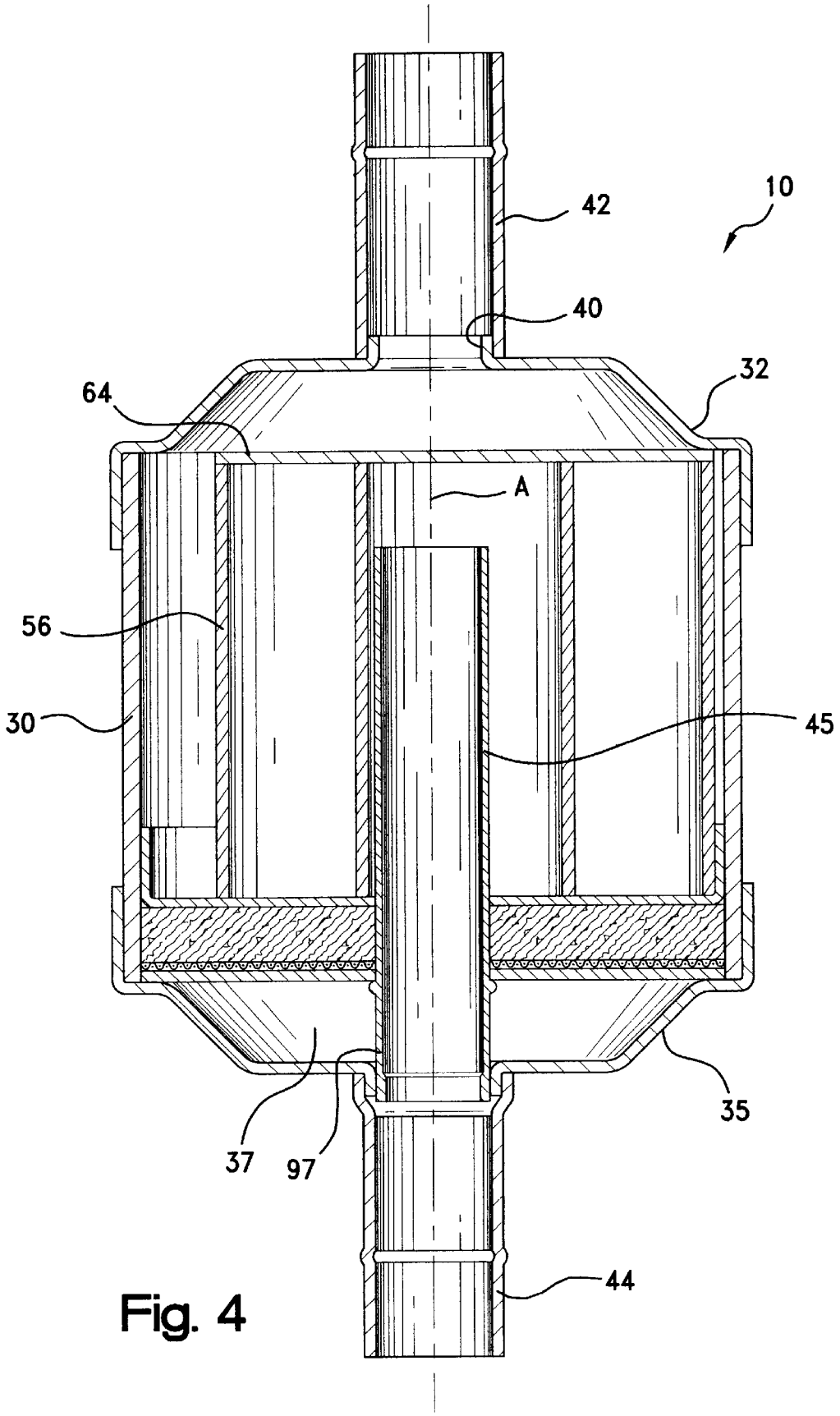
FIG. 4 is a cross-sectional view similar to FIG. 3, showing a further form of the separator.

Referring now to FIG. 4, a further form of the oil separator 10 of the present invention is shown, which is particularly suited for heat pump systems. In this form, outlet conduit portion 45 includes an opening 96 formed toward the lower end of the conduit. Filtered oil collecting in collection cavity 37 is drained directly back into outlet conduit 44, and reintroduced into the gas stream to lubricate components downstream of the oil separator 10. In this case, drain tube connection 88 and drain tube 92 (FIGS. 2 and 3) are not necessary. Such a configuration is useful for heat pump application, where for example, a downstream reversing valve must be kept lubricated. All the other components of the oil separator 10, such as cylindrical body 30, upper and lower end caps 32, 35, scroll-shaped separator baffle 56, upper baffle plate 64 and lower baffle assembly 68, are preferably the same as described previously with respect to FIGS. 2 and 3, and will not be described again for sake of brevity.

In either form of the invention described above, the scroll-shaped separator baffle 56 effectively separates the oil from the gas stream, and allows the oil to be filtered and then directed on as appropriate. It has been found that the scroll-shape of the separator baffle reduces compressor pulsations of the fluid, which reduces the overall noise level of the fluid flowing through the separator. Still further, the oil droplets are separated from the gas stream using an efficient amount of space, which reduces the overall size of the body 30. Finally, a slug of liquid refrigerant and entrained oil entering the separator such as during start up, can be allowed to fill up a substantial portion of the housing before the mixture starts to overflow into outlet conduit portion 45. The oil continues to be separated from the gas stream up to the point of overflow into the outlet conduit. This allows the system to stabilize before unfiltered oil is passed on to the outlet conduit. Moreover, even if the slug is great enough to entirely fill the housing and overflow into the outlet conduit, the separator will not clog and prevent flow through the refrigeration system, rather the flow will be maintained, albeit with unfiltered oil.

Thus, as described above, the present invention provides a new and unique oil separator for a refrigeration system which effectively and efficiently separates oil from an incoming oil/gas mixture from the compressor discharge line, directs the oil free gas stream back to the inlet of the compressor, and filters the oil. The filtered oil is then either externally drained and directed to other appropriate components in the system, such as to the suction line of the compressor, or returned directly to the outlet conduit to be reintroduced into the gas stream. The separator has a structure which reduces or muffles the noise caused by the gas/oil mixture flowing through the separator.

The principles, preferred embodiments and modes of operation of the present invention have been described in the foregoing specification. The invention which is intended to be protected herein should not, however, be construed as limited to the particular form described as it is to be regarded as illustrative rather than restrictive. For example, it is noted that while inlet conduit 42 and outlet conduit 44 are disposed along the central axis "A" of the separator on opposite ends of the housing 30, it is also possible that the inlet conduit 42 and outlet conduit 44 can be disposed on the same end of the housing 30, for example on the lower end; or that inlet conduit 42, and even outlet conduit 44 could be disposed somewhat off the central axis of the housing, and still maintain the desired function of the present invention. These configurations should be well apparent to those skilled in the art.

As such, variations and changes may be made by those skilled in the art without departing from the scope and spirit of the invention as set forth in the appended claims.

What is claimed is:

1. A device for separating oil from an oil/gas mixture received from a compressor discharge line in a refrigeration or heat pump system, the device comprising:

a cylindrical housing circumscribing a central axis with an upper separation cavity and a lower oil collection cavity;

an upper end cap on an upper end of the housing and a lower end cap on a lower end of the housing;

a scroll-shaped separator baffle disposed in the separation cavity defining a flow path extending radially-inward in a spiraling manner from a peripheral region of the housing toward the central axis of the housing;

an inlet conduit in the upper end cap aligned with the central axis directing the oil/gas mixture into the housing;

an upper baffle plate disposed in the housing and supporting an upper end of the separator baffle, said upper baffle plate directing the oil/gas mixture from the inlet conduit of the upper end cap to the peripheral region of the housing and into the separator baffle, the oil in the mixture generally separating from the gas in the mixture and depositing on the separator baffle and draining axially downward to collect in the collection cavity as the mixture flows radially inward through the separator baffle;

an outlet conduit in the lower end cap aligned with the central axis and extending upwardly into the scroll for directing the resulting oil-free gas stream from the housing; and a drain in the collection cavity for removing collected oil.

2. The device as in claim 1, further including a filter media supported at a lower end of the separator baffle, the filter media filtering the oil draining axially downward to the collection cavity.

3. The device as in claim 2, wherein said filter media is disposed in a lower baffle assembly, the lower baffle assembly including an upper circular perforated plate supporting a lower end of the separator baffle, a circular mesh screen, and a lower circular perforated plate, the filter media being interposed between the upper perforated plate and the mesh screen.

4. The device as in claim 2, wherein said drain comprises an orifice in the outlet conduit for reintroducing the filtered oil into the gas stream exiting the outlet conduit.

5. The device as in claim 2, wherein said drain includes a valve for selectively draining oil from the collection cavity externally of the device.

6. The device as in claim 1, wherein the separator baffle includes a continuously-curving wall spiraling radially-inward toward the central axis of the housing, with the wall of the separator baffle generally extending parallel to the central axis of the housing.

7. The device as in claim 6, wherein the separator baffle extends from an outer end adjacent the housing, to an inner end surrounding the outlet conduit.

8. The device as in claim 7, wherein the individual turns of the separator baffle are evenly-spaced along the entire extent of the separator baffle.

9. The device as in claim 8, wherein the separator baffle consists essentially of one and one-half turns.

10. The device as in claim 1, wherein the outlet conduit extends along the central axis of the housing to a location proximate the upper end cap.

11. The device as in claim 1, wherein said upper baffle plate has a non-circular peripheral configuration defining a series of flow paths between the plate and the housing around the outer periphery of the plate, the flow paths directing fluid to the periphery of the housing.

12. A device for separating oil from an oil/gas mixture, comprising:

a cylindrical housing circumscribing a central axis with an upper separation cavity and a lower oil collection cavity;

an upper end cap on an upper end of the housing and a lower end cap on a lower end of the housing;

a scroll-shaped separator baffle disposed in the separation cavity defining a flow path extending radially-inward in a spiraling manner from a peripheral region of the housing toward the central axis of the housing;

an inlet directing the oil/gas mixture into the housing and into the peripheral region of the separator baffle, the oil in the mixture generally separating from the gas in the mixture and depositing on the separator baffle and draining axially downward to the collection cavity as the mixture flows radially inward through the separator baffle;

filter media supported at a lower end of the separator baffle, the filter media filtering the oil draining axially downward to the collection cavity;

an outlet for directing the resulting oil-free gas stream from the housing; and a drain in the collection cavity for removing the filtered oil.

13. The device as in claim 12, wherein said filter media is disposed in a lower baffle assembly, the lower baffle assembly including an upper perforated plate supporting a lower end of the separator baffle, a mesh screen, and a lower perforated plate, the filter media being interposed between the upper perforated plate and the mesh screen.

14. The device as in claim 12, wherein said drain comprises an orifice in the outlet for reintroducing the filtered oil into the gas stream exiting the outlet.

15. The device as in claim 12, wherein said drain includes a valve for selectively draining oil from the collection cavity externally of the device.

16. The device as in claim 12, wherein the separator baffle includes a continuously-curving wall spiraling radially-inward toward the central axis of the housing, with the wall of the separator baffle generally extending parallel to the central axis of the housing.

17. The device as in claim 16, wherein the separator baffle extends from an outer end adjacent the housing, to an inner end surrounding the outlet conduit.

18. The device as in claim 17, wherein the individual turns of the separator baffle are evenly-spaced along the entire extent of the scroll.

19. The device as in claim 18, wherein the separator baffle consists essentially of one and one-half turns.

20. A device for separating oil from an oil/gas mixture, comprising:

a cylindrical housing circumscribing a central axis with an upper separation cavity and a lower oil collection cavity;

an upper end cap at an upper end of the housing and a lower end cap at a lower end of the housing;

a scroll-shaped separator baffle disposed in the separation cavity defining a flow path extending in a spiraling manner between a peripheral region of the housing and the central axis of the housing;

an inlet directing the oil/gas mixture into the housing and into the separator baffle such that the mixture flows in a spiraling manner through the separator baffle, the oil in the mixture generally separating from the gas in the mixture and depositing on the separator baffle and draining axially downward to the collection cavity as the mixture flows spirally through the separator baffle;

an outlet for directing the resulting oil-free gas stream from the housing; and a drain in the collection cavity for removing the filtered oil.

21. The device as in claim 20, and further including an upper baffle plate disposed in the housing between the separator baffle and the upper end cap.

22. The device as in claim 21, wherein the upper baffle plate supports an upper end of the separator baffle.

23. The device as in claim 21, wherein said upper baffle plate directs the oil/gas mixture from the inlet conduit to the peripheral region of the housing and into the separator baffle.

24. The device as in claim 23, further including a lower baffle plate disposed in the housing between the separator baffle and the lower end cap.

25. The device as in claim 20, further including a lower baffle plate disposed in the housing between the separator baffle and the lower end cap.

26. The device as in claim 20, wherein said drain includes a valve for selectively draining oil from the collection cavity externally of the device.

27. The device as in claim 20, wherein the separator baffle includes a continuously-curving wall spiraling radially-inward toward the central axis of the housing, with the wall of the separator baffle generally extending parallel to the central axis of the housing.

28. The device as in claim 20, wherein the separator baffle extends from an outer end adjacent the housing, to an inner end surrounding the outlet conduit.

29. The device as in claim 20, wherein the individual turns of the separator baffle are evenly-spaced along the entire extent of the scroll.

30. The device as in claim 29, wherein the separator baffle consists essentially of one and one-half turns.

31. The device as in claim 20, wherein the outlet is disposed along the central axis of the housing.

* * * * *